United States Patent [19]

Heyne

[11] 4,135,429

[45] Jan. 23, 1979

[54] PIANO BASS STRING

[76] Inventor: Klaus-Peter Heyne, 6200 Wiesbaden, Fed. Rep. of Germany

[21] Appl. No.: 697,377

[22] Filed: Jun. 18, 1976

[30] Foreign Application Priority Data

Mar. 13, 1976 [DE] Fed. Rep. of Germany ..... 2610588

[51] Int. Cl.[2] ..... G10C 3/06

[52] U.S. Cl. ..... 84/199; 84/297 S

[58] Field of Search ..... 84/199, 297 S

[56] References Cited

U.S. PATENT DOCUMENTS

| | | | |
|---|---|---|---|
| 446,618 | 2/1891 | Burdon | 84/199 X |
| 740,918 | 10/1903 | Ramacciotti | 84/199 |
| 1,277,744 | 9/1918 | Nicolle | 84/199 |
| 1,383,174 | 6/1921 | Udy et al. | 84/297 S |
| 3,099,595 | 7/1963 | Allbaugh | 84/297 S |
| 3,120,144 | 2/1964 | Bayer | 84/297 S |
| 3,605,544 | 9/1971 | Kondo | 84/297 S |

FOREIGN PATENT DOCUMENTS

| | | | |
|---|---|---|---|
| 897155 | 5/1962 | United Kingdom | 84/297 S |

*Primary Examiner*—Lawrence R. Franklin
*Attorney, Agent, or Firm*—Gifford, Chandler, VanOphem, Sheridan & Sprinkle

[57] ABSTRACT

A piano bass string includes a load carrying wire and at least one wire encircling the load carrying wire with the encircling wire made up of a tubular casing of a drawable material and a core which is heavier than the drawable material.

4 Claims, 3 Drawing Figures

PIANO BASS STRING

The invention relates to a piano bass string consisting of a load bearing wire and at least one layer of incircling wire.

The harmonic vibrations of a string are in accordance with the formula $$\nu_k = \frac{K}{2l}\sqrt{\frac{S}{m}}$$

where K = 1, 2, 3 . . . and 1 denotes the length, S the tensioning force and $\eta$ the mass per unit length of the string. In instruments the choice of length of the string is restricted so that the mass per unit length, $\eta$, is the factor remaining which can be used to determine the basic frequency. In piano construction use is therefore made of piano bass strings in the form of wires with material wound or spun round them. The load bearing steel wire is usually wound with one or two layers of copper. For the production of exclusively harmonic vibrations the string should be as flexible as possible; the thicker the encircling wire layers are, the stiffer the string is however and the percentage of non-harmonic vibrations in the over-tones increases.

The object of the invention is that of providing a form of a piano bass string of the generic type with a small diameter so that the tone quality is improved as regards the percentage of harmonics in the over-tones.

This object is achieved in that the encircling wire comprises a tubular casing or sheath of a material which can be drawn and a core of a material which is heavier than the material which can be drawn. Preferably copper is used as the material for the casing or sheath and lead is used as the material of the core.

Such a piano bass string not only has an improved tone quality but is also cheaper to produce than known constructions.

BRIEF DESCRIPTION OF THE DRAWINGS

The invention will be explained with reference to the drawing in which.

Figure 1:
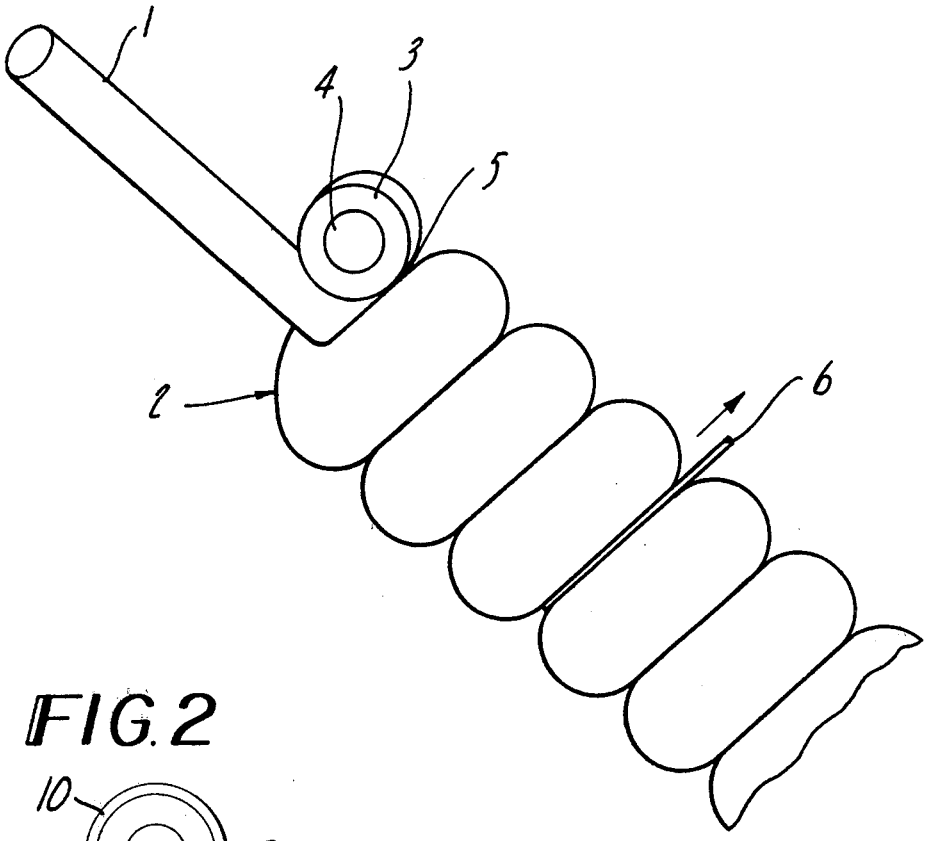
FIG. 1 is a plan view showing the present invention.

This drawing shows a load carrying wire 1 of steel and one layer of encircling wire 2 made up of a casing metal 3 and a core metal 4. As a casing metal use is made of a metal which can be drawn or a metal alloy, more especially copper but also iron, silver and other materials, which can be drawn can be used, while as a core material use is made of a heavy metal, more especially lead. For settling the value $\eta$ in accordance with the desired frequency the ratio of the proportion of the casing and of the core can be selected in accordance with the requirements, that is to say for high frequencies the proportion of the casing can be larger than for lower ones assuming the same diameter of the encircling wire 2. It is furthermore not necessary for the string to be homogeneous and for example it could be made up of layers in which case layers of casing metal and core metal would alternate. For particularly low frequencies two layers of encircling wire will be used so that the latter can be made relatively thin, something which involves advantages on winding.

As will be seen from the drawing, two adjacent coils of the encircling wire make contact along a helical line 5, which does not excessively impair the flexibility of the string, if the radius of the helix is not excessively large. It is, however, also possible to ensure that between the coils of the helix a small gap is present, which however must be very even in order not to impair the vibrational characteristics of the string. Such a small distance can for example be produced by winding in a plastics foil tape 6 on winding the encircling wire around the load carrying wire 1 and this plastics foil tape is then removed.

Figure 3:
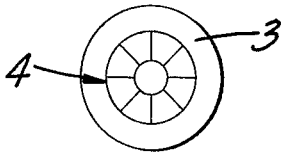
FIG. 3 is a plan view similar to FIG. 2, but showing a still further modification.

The production of the encircling wire is carried out as follows: As a starting material a piece of tube or pipe of the material which can be drawn is used and the cavity in it is filled with the heavy metal. Following this the tube is drawn through a die or nozzle and as a result it is extended. Repeated reduction is made by drawing through different dies. In this way the desired diameter of the encircling wires is produced. It is possible to produce sufficiently thin encircling wires. It is also possible to fill the starting tube with an encircling wire or several encircling wires which are already stretched and then subject this structure to further processing so that one finally produces an encircling wire with a layered or honeycomb structure (FIG. 3). This can be advantageous in the case of the use of lead as a core metal, since lead is relatively soft and the repeated layers of the casing metal provide a supporting matrix. The layered construction or structure can also influence the timbre so that there is a further possibility of selection in this respect.

As a casing metal which can be drawn it is preferred to use copper and as a core metal lead is preferred, which as is known has a different modulus of elasticity. The modulus of elasticity influences the timbre of the core so that this timbre can also be influenced by different proportions of copper and lead. As a result it is possible to ensure that there is no discontinuity on passing from very deep tones to medium deep tones.

Figure 2:
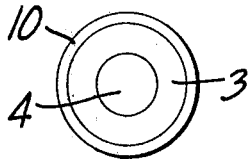
FIG. 2 is a plan view similar to FIG. 1, but with parts removed and showing a modification thereof.

In order to influence the coupling between the individual coils of the encircling wire the latter can have a thin plastic coating 10 (FIG. 2). In this manner a further possibility for influencing the tone generated by the string is provided.

I claim:

1. A piano bass string comprising a load carry wire and at least one layer of encircling wire wrapped around said load carrying wire, wherein the encircling wire comprises a tubular casing formed from a drawable material, said casing being made of copper, and drawn over a core of material which is heavier than the drawable material, said core being made of lead.

2. A piano bass string as defined in claim 1, characterized in that the ratio of the fraction of the casing to the core is dependent upon the desired vibration frequency for the bass string, wherein for relatively higher frequencies, the proportionate fraction of the casing increases while for relatively lower frequencies the proportional fraction of the core increases.

3. A piano bass string as defined in claim 1, wherein the individual coils of the encircling wire around the load carrying wire are spaced a small and substantially constant distance from each other.

4. A piano bass string as defined in claim 1, and including a thin plastic outer coating around said encircling wire.

* * * * *